United States Patent [19]

Bocca et al.

[11] 4,242,770

[45] Jan. 6, 1981

[54] DEVICE FOR INFEEDING A STRIP OF FLEXIBLE MATERIAL FOR USE IN MACHINES FOR BINDING THIN ARTICLES AND, IN PARTICULAR, MACHINES FOR EDGING PARTS FOR BOOTS AND SHOES

[75] Inventors: Alberto Bocca; Mario Pagani, both of Vigevano, Italy

[73] Assignee: Sagitta Officina Meccanica S.p.A., Italy

[21] Appl. No.: 891,758

[22] Filed: Mar. 30, 1978

[30] Foreign Application Priority Data

Apr. 1, 1977 [IT] Italy ..... 22034 A/77

[51] Int. Cl.[3] ..... A43D 43/06; A43D 11/00; B65H 17/36; B32B 3/04

[52] U.S. Cl. ..... 12/24.5; 12/59.5; 226/160; 226/162; 156/447; 156/480; 156/522

[58] Field of Search ..... 156/522, DIG. 33, 475, 156/479, 480, 447, 478; 226/160, 162, 163, 164, 165, 166, 167; 12/24.5, 20.0, 59.5

[56] References Cited

U.S. PATENT DOCUMENTS

| | | | |
|---|---|---|---|
| 1,661,383 | 3/1928 | Osgood | 12/59.5 |
| 2,518,011 | 8/1950 | Hoppe | 156/DIG. 33 |
| 3,475,256 | 10/1969 | Bocca et al. | 156/480 |

*Primary Examiner*—John T. Goolkasian
*Assistant Examiner*—Lois E. Rodgers
*Attorney, Agent, or Firm*—Robert E. Burns; Emmanuel J. Lobato

[57] ABSTRACT

Device for infeeding a strip of flexible material for use in a machine for binding articles in particular for edging parts for boots and shoes. The infeed device has a quadrant mounted in advance of a cutting mechanism on the machine.

3 Claims, 11 Drawing Figures

DEVICE FOR INFEEDING A STRIP OF FLEXIBLE MATERIAL FOR USE IN MACHINES FOR BINDING THIN ARTICLES AND, IN PARTICULAR, MACHINES FOR EDGING PARTS FOR BOOTS AND SHOES

BACKGROUND OF THE INVENTION

This invention relates to a device for infeeding a strip of flexible material in machines for binding thin articles and, in particular, for edging parts for boots and shoes, such as soles, insoles and the like, the said machines comprising means for placing adhesive between the said strip and the articles to be edged, mechanism actuated by control means provided with a reciprocating motion, for cutting the said strip, mechanism for folding the said strip partly above and partly below the outline of the said articles, and pressure and transportation mechanism for intermittently pressing the strip against the articles and for causing the said articles to be moved forward as they arrive.

At the present time, to infeed the strip in binding machines, a device (described in Patent Application No. 20529 A/71 deposited on 13.2. 1971 in the name of the same applicants as herein) is used and provision is made in this for the strip to pass through a pair of rollers, one of which is turned (via a rack and freely disengaged gear system) by the reciprocating motion of the rod that operates the strip cutting mechanism, so that the said strip is made to move forward after each cutting operation.

The device is, however, somewhat complicated and operationally unreliable because of the possibility the strip has of sliding out of position and of imperfections occurring during machining.

Furthermore, a certain difficulty is experienced with the aforementioned device in inserting the strip between the pair of rollers in phase with the starting up of the binding machine, and this results in time being wasted and in production costs becoming greater.

SUMMARY OF THE INVENTION

The fundamental feature of the present invention is to make available a device for infeeding a strip in binding machines that is simple and rational from a structure point of view, is operationally reliable, and in which the initial insertion of the strip is particularly easy.

This problem is solved with the infeed device according to the invention because of the fact that it comprises a quadrant mounted ahead of the cutting mechanism, this having the possibility of oscillating around an axis perpendicular to the direction in which the said strip moves forward, a gripper unit mounted on the said quadrant to take firm hold of the strip and to cause it to move forward towards the cutting mechanism while the quadrant itself travels forward, and operating means with which to cause the quadrant to undergo a pendulum motion and the gripper unit to close and to open during the forward and return travel, respectively, of the quadrant, the said operating means being connected to the cutting mechanism control unit so as to bring about the forward movement of the strip, immediately after it has been cut, until the free end thereof has been carried to a point corresponding to where the folding mechanism and the said pressure and transportation mechanism are positioned.

BRIEF DESCRIPTION OF THE DRAWINGS

One preferred but not the sole form of embodiment for the infeed device according to the invention is illustrated with reference to the accompanying drawings, in which.

DESCRIPTION OF THE PREFERRED EMBODIMENTS

Figure 1:
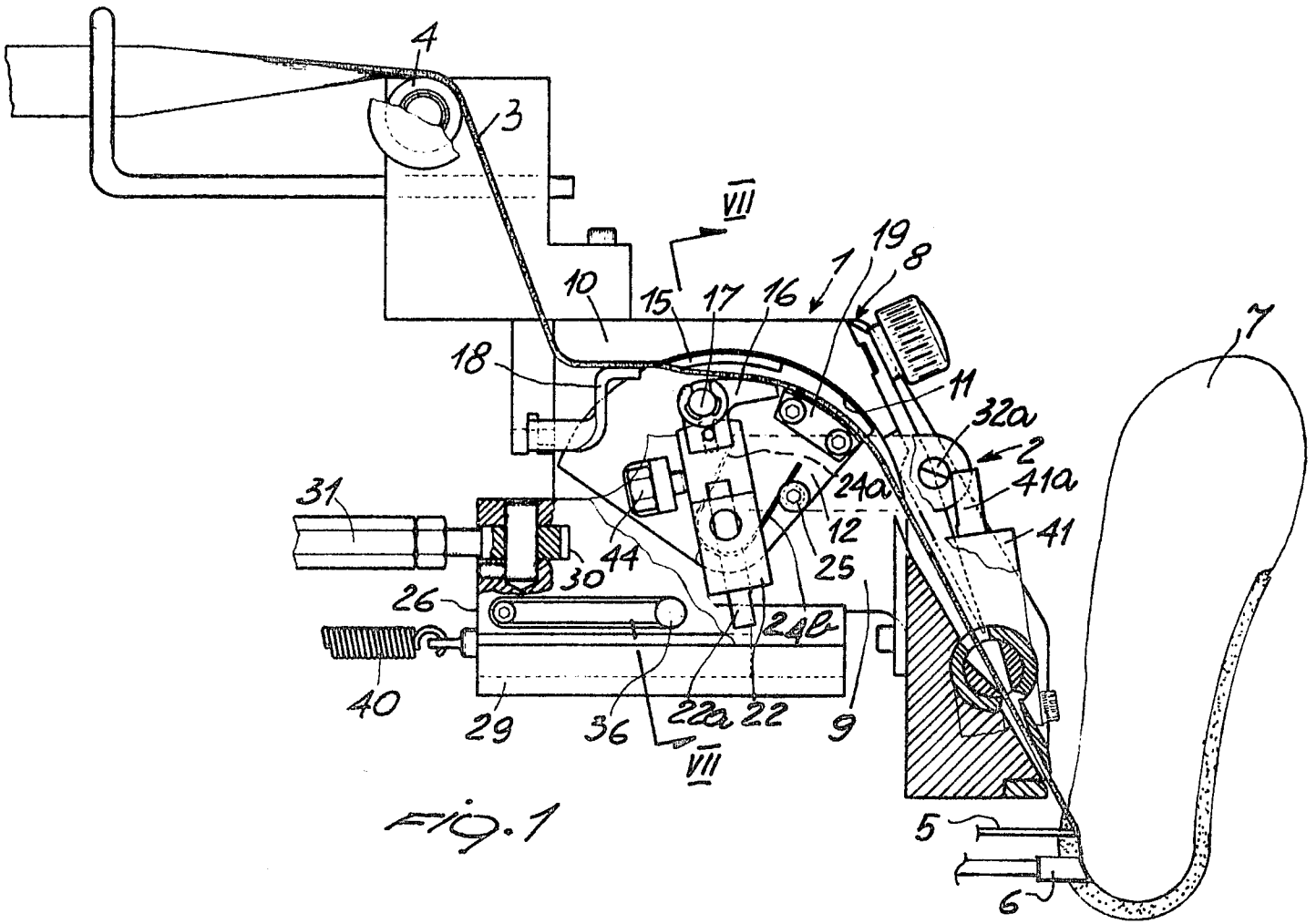
FIGS. 1–6 show, in plan view form, the device according to the invention in various positions applicable to one operating cycle.
Figure 2:
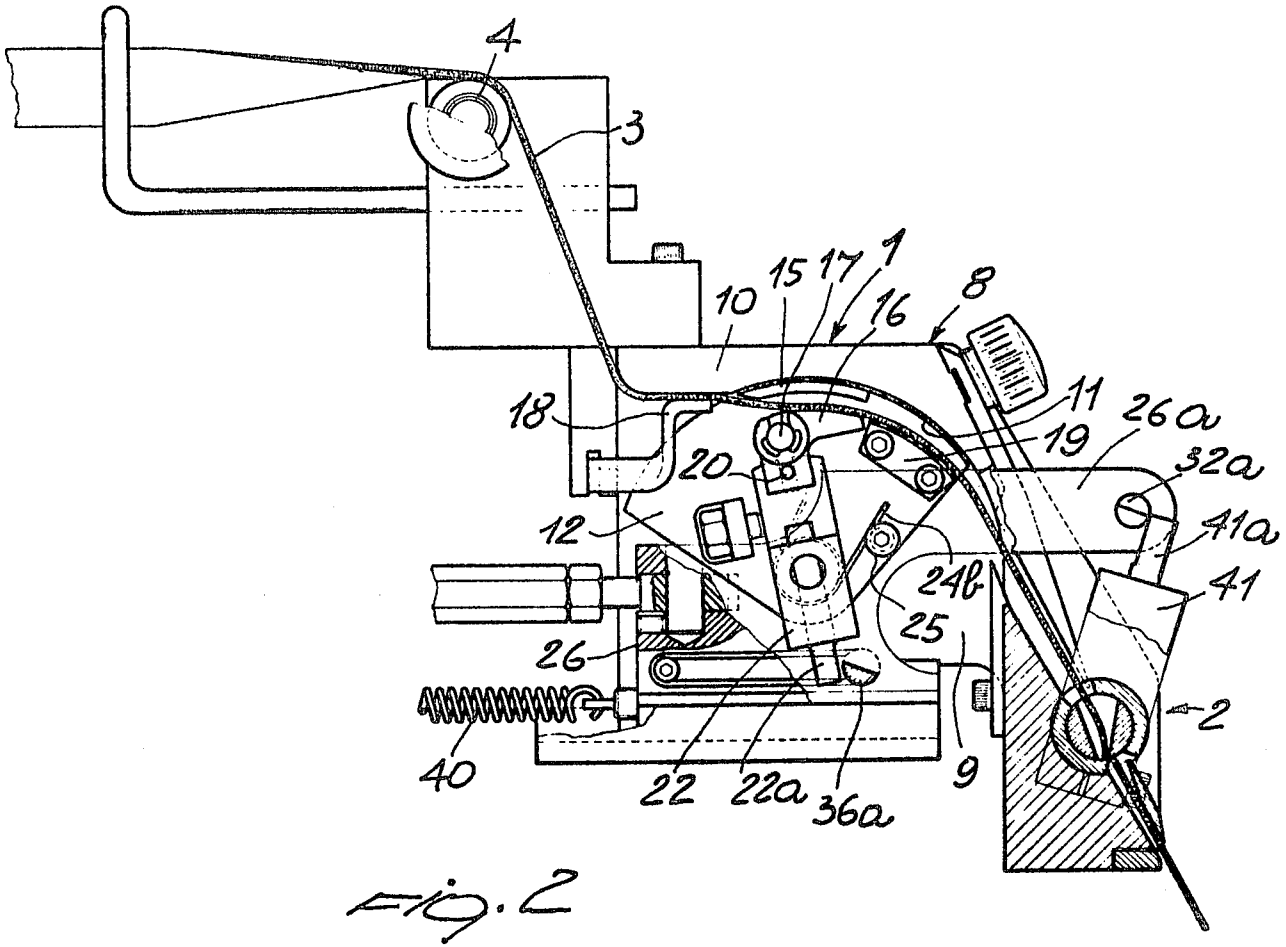

With reference to FIG. 1, the infeed device according to the present invention, indicated globally at 1, has to be mounted on a binding machine ahead of the cutting mechanism, indicated generally at 2, in itself known. In the example illustrated, the cutting mechanism is of the type envisaged in the aforementioned Pat. No. 20529 A/71, though it can obviously be of some other different type.

The strip 3 arrives at the device 1 passing over a transmission roller 4, and after then being inserted into and passing through the cutting mechanism 2, the strip 3 reaches the point where the parts 5 and 6 (FIG. 1), in themselves known, are positioned, in order that the strip be applied to the article to be edged (for example, an insole 7, as shown in FIG. 1), and that the article be displaced as it is gradually being edged.

The device 1 is mounted in the region of a fixed retainer structure 8, shaped substantially in the form of a box, and having a flat horizontal base 9 from which a section of a wall 10 rises to define an internal cylindrical surface 11 virtually parallel to the strip 3.

A quadrant 12 is mounted coaxial to the surface 11 and this is able to oscillate around a vertical axis substantially perpendicular to the direction in which the strip 3 is displaced.

More precisely, the quadrant 12 is formed out of a horizontal plate mounted immediately above the base 9 of the structure 8, and the plate is provided in its lower portion with a pin 13 on a vertical axis, which is inserted into a ball bearing 14 (FIGS. 7 and 8) fixed to the base 9 of the box shaped structure 8, in such a way that the quadrant can oscillate gripping the base 9 and the wall 10.

On the quadrant 12 there is a gripper unit formed out of a fixed member and an oscillating member placed close to each other. The fixed member is constituted by an arcuate plate shaped body 15 arranged vertically on the curved side of the quadrant 12 and integral therewith, while the movable member is constituted by a beak shaped part 16 pivotally attached to a vertical pin 17 integral with the quadrant 12.

Guided by a connecting plate 18 integral with the structure 8 and positioned close to the wall 10 ahead of the gripper unit, the strip 3 is made to pass between the aforementioned members 15 and 16 of the gripper unit.

Once it has passed through the gripper unit, the strip 3 slides over an arcuate guide plate 19 mounted on the quadrant 12, which is provided to guide the strip towards the cutting mechanism 2.

Figure 7:
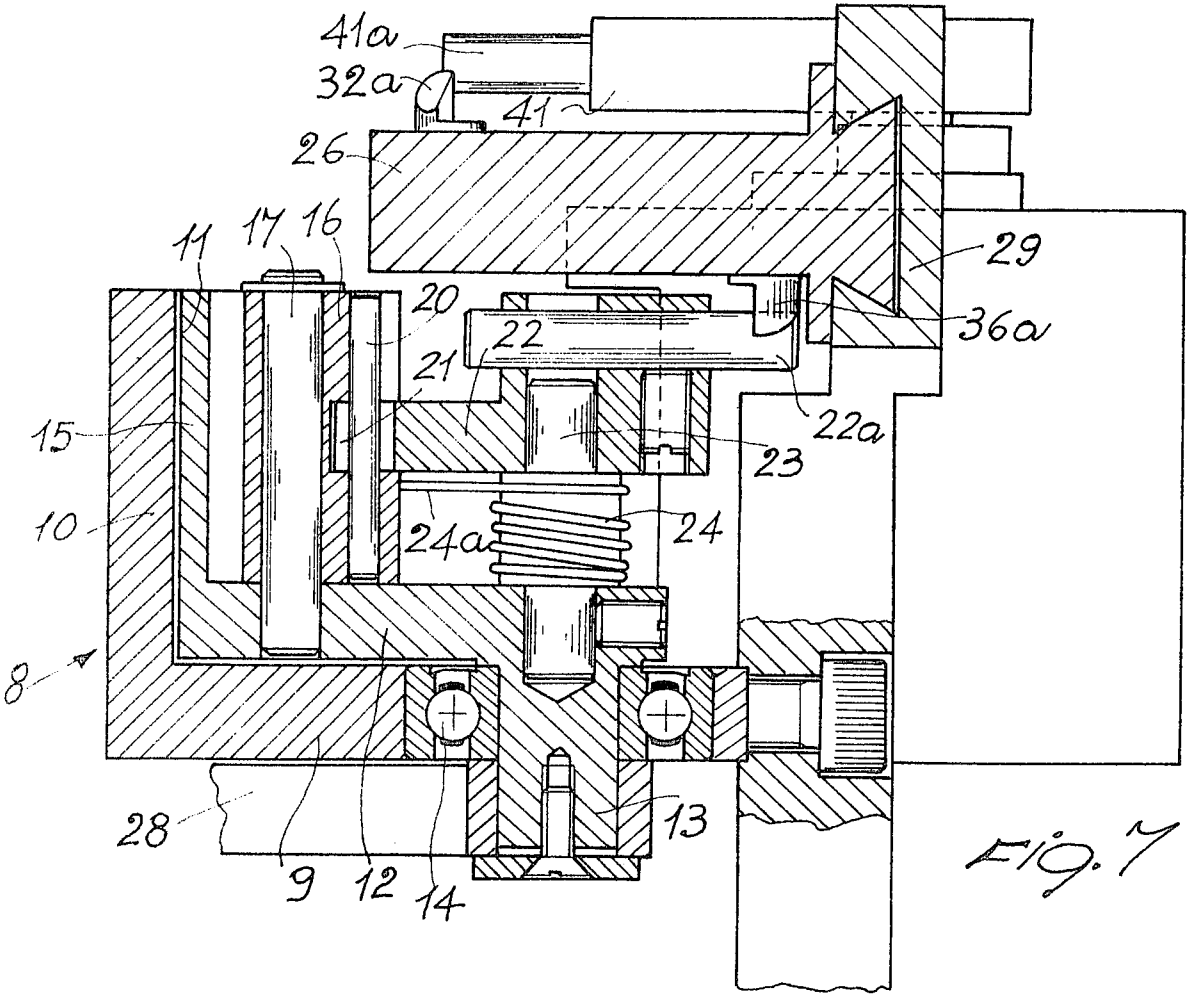
FIG. 7 shows, in an enlarged scale, a cross section along the line VII—VII in FIG. 1.

Seen in a plan view, the beak shaped part 16 is shaped in the form of an L, with the pin 17 passing through its central region, and it is provided, in its internal section, with a vertical pin 20 which engages in a groove 21 in one extremity of an oscillating lever 22 mounted on the quadrant 12 (FIG. 7). The lever 22 extends horizontally and is pivoted, at one of its intermediate points, onto a vertical pin 23 coaxial to the pin 13 of the quadrant 12 (FIG. 7). The pin 23 carries a spring 24, one extreme part of which, 24*a*, engages with the beak shaped part 16, while the other extreme part 24*b* engages with a protrusion 25 integral with the quadrant 12. Arranged in this way, the spring 24, which has a tendency to unwind, pushes the lever 22 against an adjustable trip 44 mounted on the quadrant 12, and when the lever rests against the trip 44, the member 16 of the gripper unit is in its open position (FIG. 1).

Figure 5:
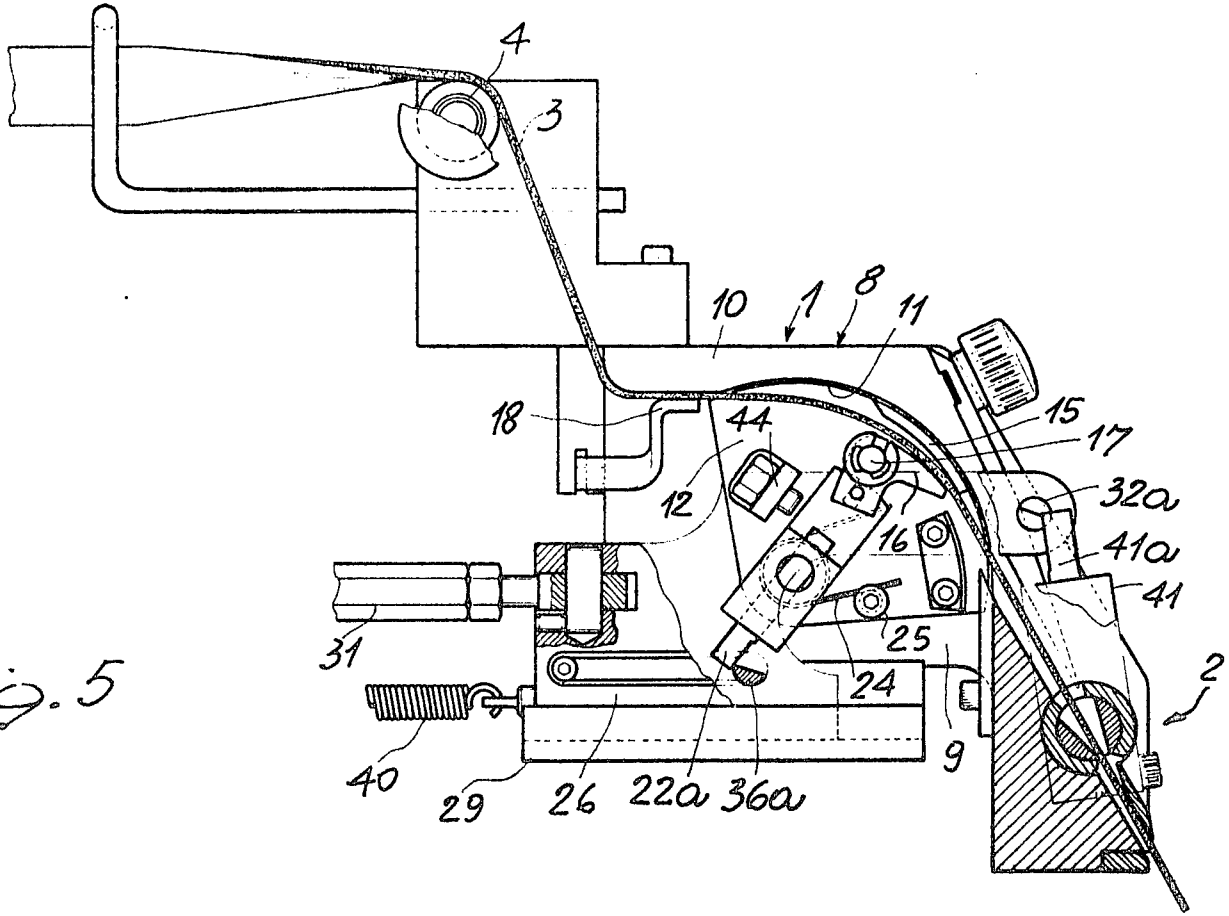
Figure 6:
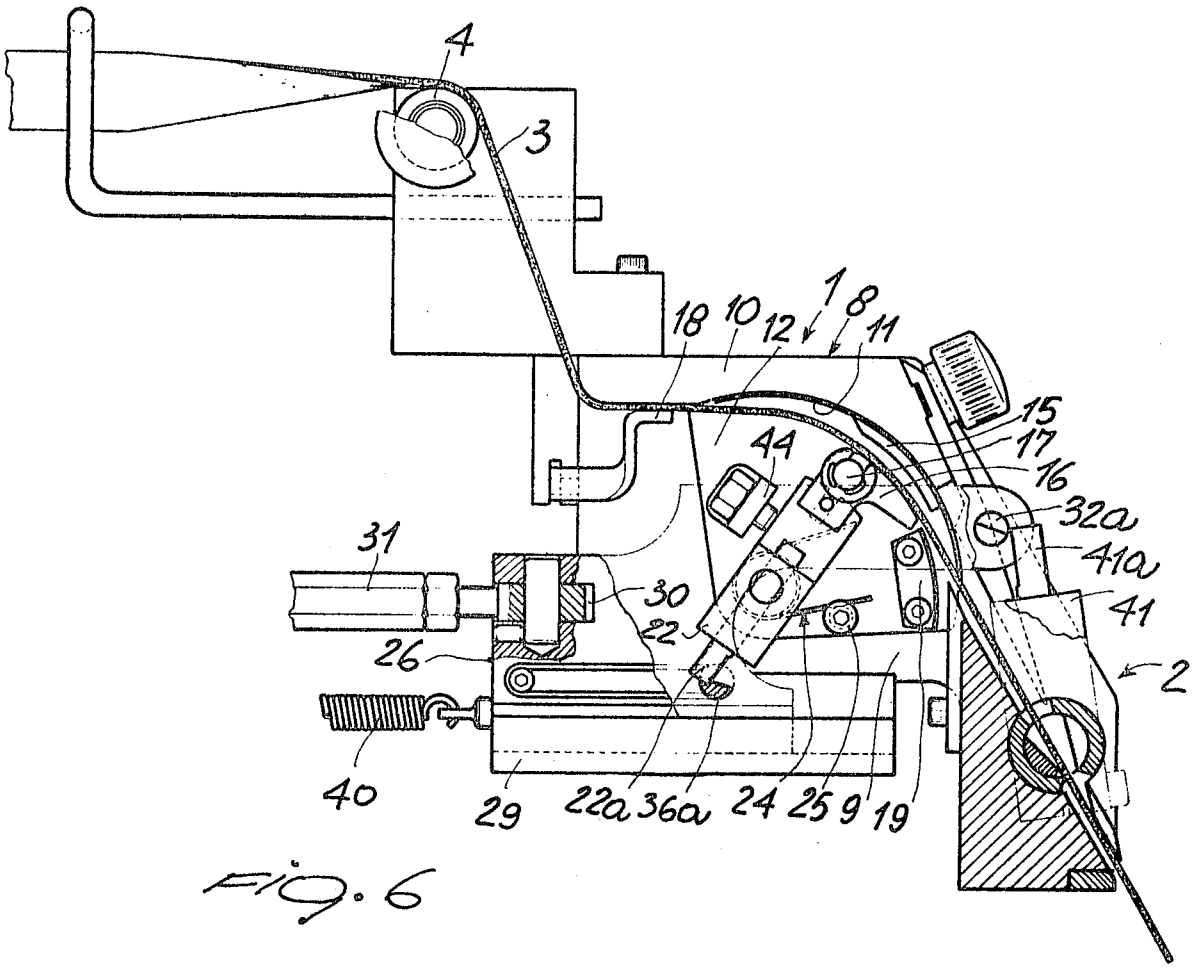

As will be seen more clearly in due course, the quadrant 12 can be displaced from an off position, shown in FIG. 1, up to a forward limit position, shown in FIG. 5, and vice versa, the forward travel is determined by a plate shaped slide 26, as will be explained below, while the return travel results from the action of a spring 27 (FIG. 8) having one extremity fastened to the structure 8, and the other to the free end of an arm 28, the lower part of which is keyed onto the pin 13. The pull applied by the spring 27 must be greater than that applied by the spring 24.

The aforementioned slide 26, constituted by a plate shaped body arranged horizontally above the box shaped structure 8 with the possibility to effect a to-and-fro motion in a horizontal direction, is provided in order to cause the quadrant 12 to oscillate, the gripper unit to open and close, and the cutting mechanism 2 to operate. The said slide can be seen in FIGS. 7 and 9, whilst in FIGS. 1 to 6 it is partially illustrated in thin line transparent sections which enable the parts underneath to be visible.

Furthermore, thanks to a dovetail connection, the slide 26 runs smoothly in a horizontal guide 29 integral with the fixed structure of the machine, this being arranged laterally and in an overhead position with respect to the quadrant 12.

Figure 9:
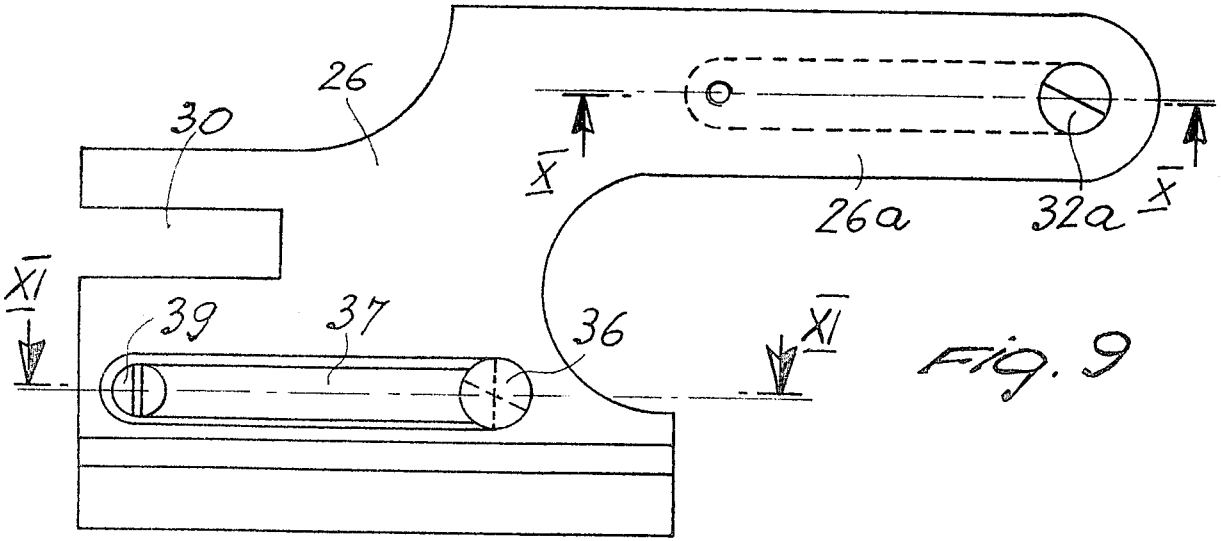
FIG. 9 shows, in a plan view, the slide of the device, in the same scale as FIGS. 7 and 8.

As can be clearly seen in FIG. 9, the slide 26 is provided with a main part in which there is a groove 30 and into this can be fixed the head of a control rod 31 (FIG. 1), which can be made to move to-and-fro in the way desired (for example, through an electromagnet, a fluid-dynamic cylinder, or any other similar means).

Figure 10:
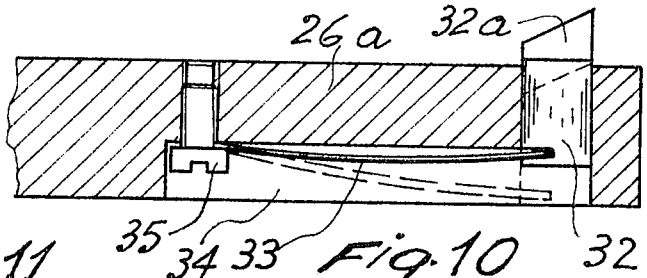
FIG. 10 is a section along the line X—X in FIG. 9.

The slide 26 has in addition an extension 26*a*, the extremity of which carries a vertical cylindrical rung or ratchet type rung shaped member 32 which slides axially in a hole provided for this purpose, and the rung shaped member has a groove in which one end of a leaf spring 33, inserted in a slot 34, is fixed. The other extremity of the spring is fastened to the extension 26*a* by means of a screw 35 (FIG. 10). Because of this arrangement, the ratchet type rung shaped member 32 is normally thrust upwards in such a way as to cause the semi-cylindrical extremity 32*a* thereon, cut obliquely for it to take on the conformation of an inclined plane, to protrude from the extension 26*a*; as will be seen in due course, it can be lowered elastically until the position shown with dashes in FIG. 10 has been reached.

Figure 11:
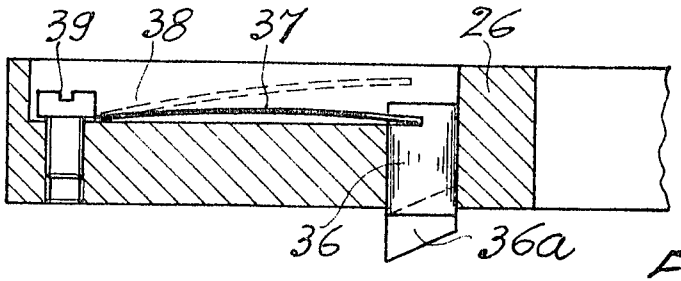
FIG. 11 is a section along the line XI—XI in FIG. 9.

With an arrangement identical to that just described, the slide 26 supports, in proximity of the slide guide, a second ratchet type rung shaped member 36 (FIG. 11) which slides axially in a hole provided for this purpose and is thrust downwards by a leaf spring 37 housed in a slot 38 and anchored by means of a screw 39. In this way, the rung shaped member 36 protrudes from the bottom of the slide 26 through one of its terminal parts 36*a*, which is semi-cylindrical and is cut obliquely so as to take on the conformation of an inclined plane. The rung shaped member 36 can be thrust upwards until it has reached the position shown with dashes in FIG. 11.

As stated, the forward travel of the slide 26 (from left to right with reference to FIGS. 1 to 6) can be brought about using any operating means (not illustrated) in conjunction with the rod 31, while the return travel of the slide can be effected under the action of a spring 40, one extremity of which is fastened to the said slide and the other to a point on the fixed structure of the machine.

During its forward travel, the slide 26 actuates, through the ratchet type rung shaped member 32, the lever 41 that operates the cutting mechanism 2, and this is done through the engagement of the extremity 32*a* on the said rung shaped member with a projection 41*a* carried by the said lever 41 and adjustable thereon.

Once the rung shaped member 32 has passed the projection 41*a*, the lever 41 returns towards its initial non-operative position under the action of a spring 42 (FIG. 8), one extremity of which is integral with the structure 8, and the other secured to an arm 43 integral with the said lever 41.

During the return travel of the slide 26, the inclined plane arrangement of the extremity 32*a* on the rung shaped member 32 permits the said rung shaped member to pass, lowering itself, underneath the projection 41*a*.

Likewise but in the reverse direction, the rung shaped member 36 comes into contact with a projection 22*a* fixed to the lever 22 (FIG. 7) in an adjustable fashion.

More precisely, the inclined plane arrangement of the extremity 36*a* of the rung shaped member 36 permits the said rung shaped member to rise in contrast with the action of the spring 37 and to pass beneath the projection 22*a*, without engaging with it, during the displacement towards the right of the slide 26. During the travel towards the left of the said slide, the extremity 36*a* engages, instead, with the projection 22*a* and this brings about two successive movements. The first movement is constituted by a brief clockwise rotation on the part of the lever 22 with respect to the quadrant 12, which remains immobile during this first phase (FIG. 4); the second movement relates to the angular displacement of the quadrant 12 in a clockwise direction (FIG. 5).

During the first movement, the gripper unit closes; in other words, the beak shaped part 16 rotates around the pin 17, approaches the fixed member 15 and grips the strip 3; immediately afterwards, as the slide 26 continues to be displaced towards the left, the second movement takes place and this determines the forward motion of the strip 3 (which stays in the tight hold of the gripper unit) through the rotation of the quadrant 12.

The complete operational sequence thus takes place in the following way (FIGS. 1 to 6).

Under normal conditions (FIG. 1), the strip 3 slides freely through the mechanism and thence it crosses through the cutting mechanism 2 in order to reach the application and transportion means, 5 and 6, respectively. In this way, the strip 3 is then applied to the outline of the article 7 which can be edged completely (immediately upstream of the means 5 and 6 there are also means, not shown since in themselves they are known, for spreading adhesive between the strip 3 and the article 7).

Figure 3:
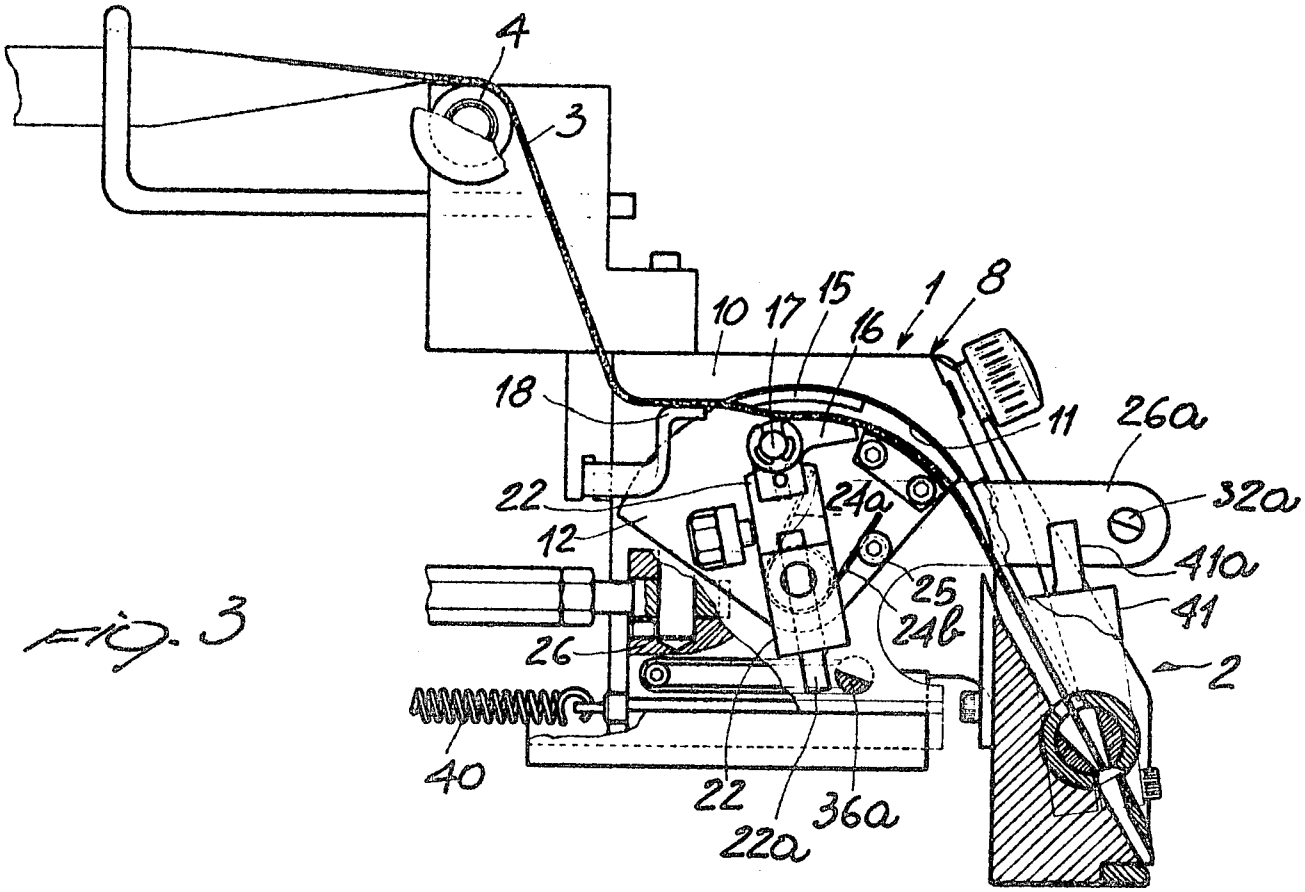
Figure 4:
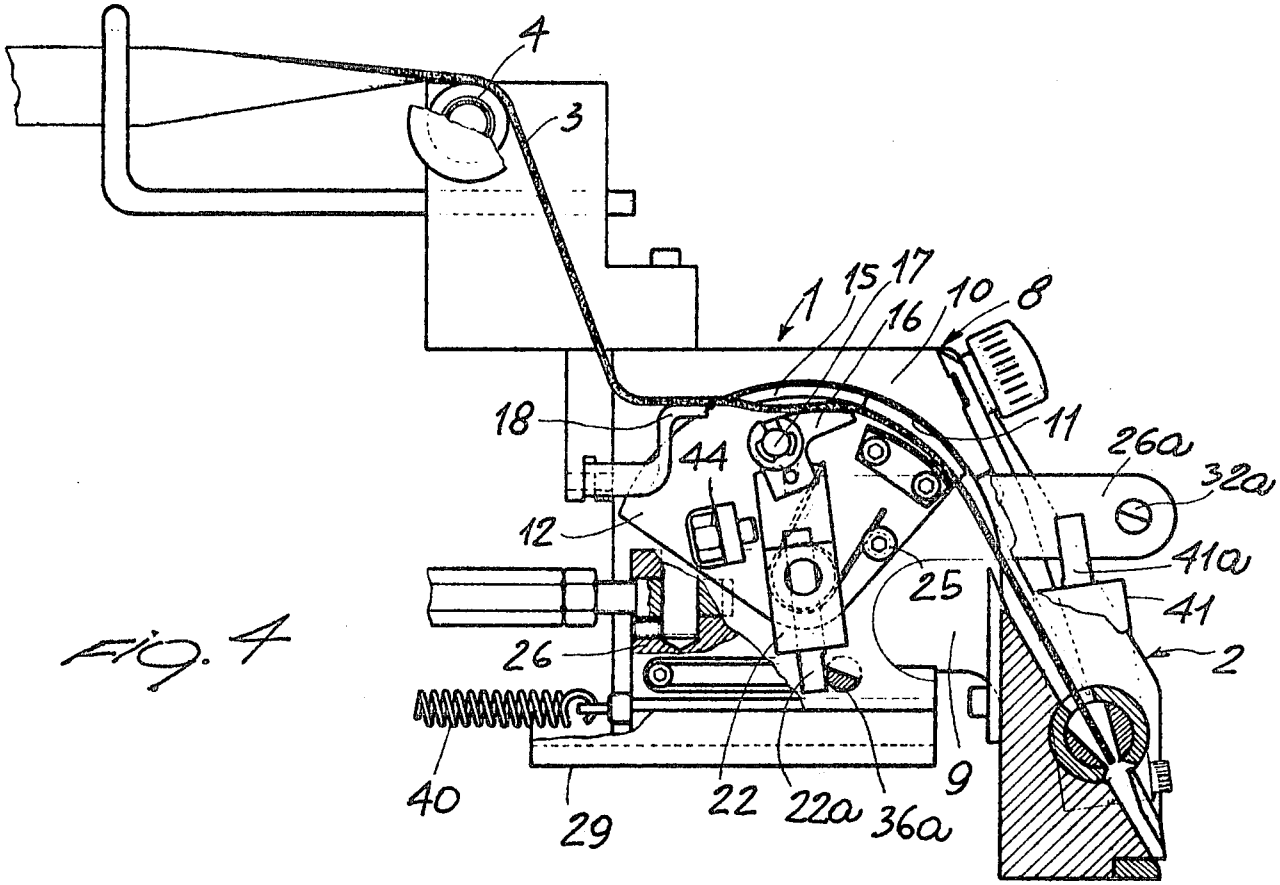
Figure 8:
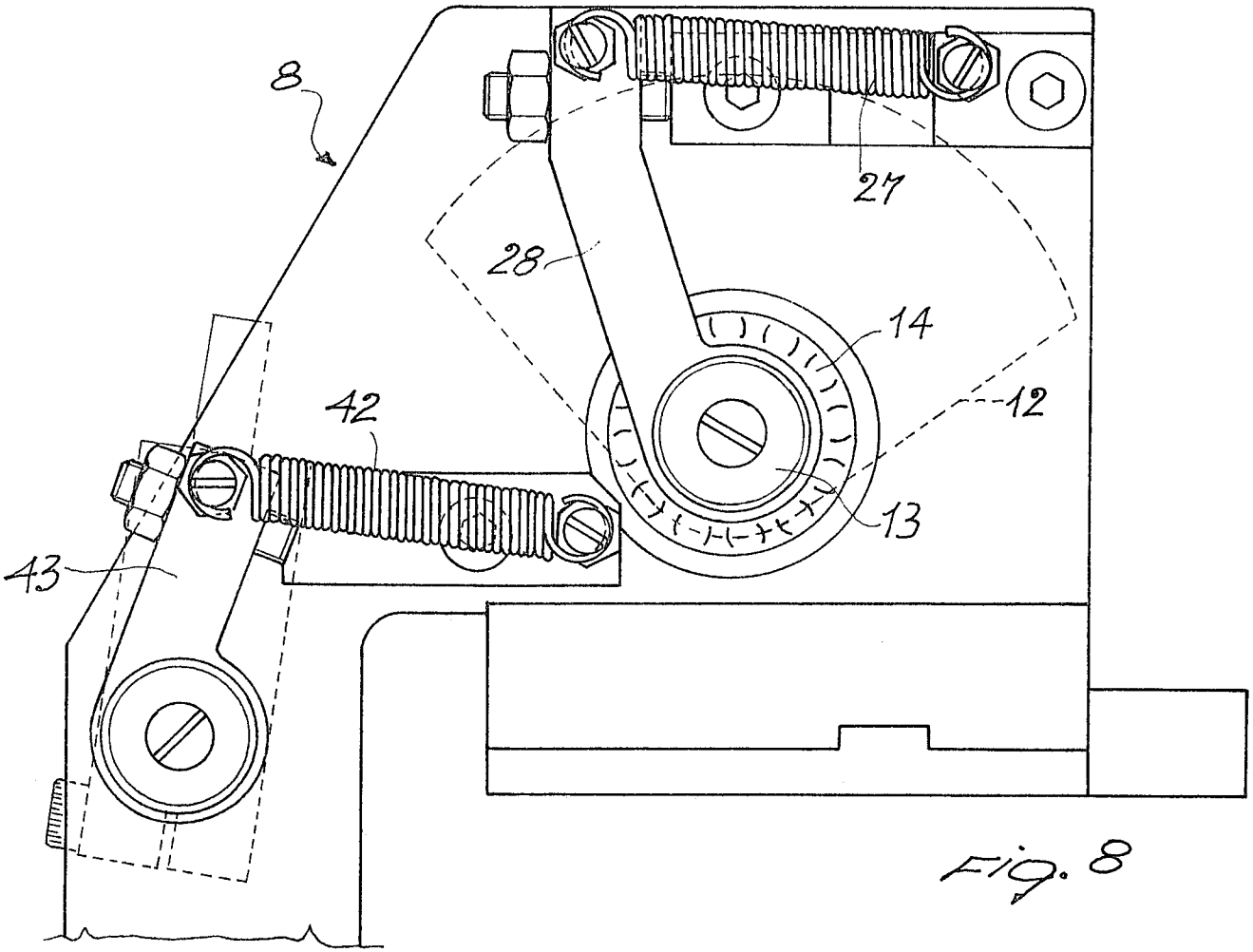
FIG. 8 is a view, seen from below, of the device, in the same scale as FIG. 7.

Once the article 7 has been edged, the operation of cutting the strip 3 has to be performed. For this, the slide 26 is made to be displaced towards the right and thus it alters over from the position indicated in FIG. 1 to that in FIG. 2, determining the rotation of the lever 41 through the action of the rung shaped member 32. Thus the strip 3 is cut (FIG. 2) while the slide moves slightly further to the right so that the rung shaped member 32 can move past the projection 41*a* and thereby allow the lever 41 to return to its initial position through the action of the return spring 42 (FIGS. 3 and 8).

At this juncture, because of the action of the return spring 40, the return travel of the slide 26 commences (from right to left). While in the previous phase the rung shaped member 36 passed above the projection 22*a*, rising without engaging with it, this time the rung shaped member does engage with the projection (FIG. 4) through its extremity 36*a*, thereby bringing about the aforementioned two movements. That is to say, first of all the lever 22 (FIG. 4) is displaced so as to close the gripper unit in contrast with the action of the spring 24 (which is weaker than the spring 27) and, subsequently, the quadrant 12 moves in a clockwise direction (FIG. 5) in contrast with the action of the return spring 27 (FIG. 8), while the gripper unit remains closed.

In this way, the forward motion of the strip 3 is made possible and the free end of this reaches the means 5 and 6.

In the last stage of the return travel of the slide 26 (FIG. 6), the disengagement occurs between the extremity 36*a* of the rung shaped member 36 and the projection 22*a*, and thus the gripper unit opens through the action of the spring 24, the quadrant 12 rotates anticlockwise, returns to its initial position through the action of the return spring 27, and the connecting plate 18 prevents the strip from backtracking.

The device 1 returns, therefore, to its initial non-operative condition (FIG. 1) with the lever 22 resting on the trip 44 and the quadrant 12 tightly up against the side of the structure 8. The device remains in this particular state until it is recalled into operation, in the way described above, when the strip is subsequently cut again.

In this way, immediately after each operation of cutting the strip 3, the device causes the strip to move forward a sufficient distance for the free end thereof to be carried to the application and transportation means.

This invention is naturally not limited solely to the form of embodiment described herein, and numerous modifications and variants are possible thereto, all of which falling within the framework of protection afforded to the invention.

What is claimed is:

1. An infeed device for infeeding a strip of flexible material, said infeed device capable of being used in a machine for binding thin articles and, in particular, a machine for edging parts for boots and shoes, said machine comprising, means for placing adhesive between said strip and the articles to be edged, cutting mechanism actuated by control means provided with a reciprocating motion, for cutting said strip, mechanism for folding the strip partly above and partly below the outline of the said articles, and pressure-applying and transportation mechanism for intermittently pressing the strip against the articles and for causing the articles to be moved forward as they are edged, said infeed device comprising a quadrant mounted ahead of said cutting mechanism oscillatable around an axis perpendicular to the direction in which said strip moves forward, a gripper unit mounted on said quadrant to take firm hold of the strip and to move it forward towards said cutting mechanism while the said quadrant travels forward, and operating means with which to cause the said quadrant to undergo a pendulum motion and said gripper unit to close and to open during the forward and return travel, respectively, of said quadrant, said operating means being connected to the cutting mechanism control unit so as to bring about the forward movement of the said strip, immediately after it has been cut, until the said strip, immediately after it has been cut, until the free end thereof has been carried to a point corresponding to where said folding mechanism and said pressure-applying and transportation mechanism are positioned.

2. Device according to claim 1, wherein said operating means for causing the said quadrant to oscillate and for opening and closing the said gripper unit comprise a plate-shaped slide mounted to slide to-and-fro above said quadrant, a first ratchet type rung shaped member on said slide for actuating said cutting mechanism during forward movement of the slide, and a second ratchet type rung shaped member for operating said gripper unit and said quadrant, during the return travel of the slide, means provided for causing said slide to undergo reciprocating displacement movements.

3. Device according to claim 1 or claim 2, wherein said gripper unit constitutes an arcuate plate-shaped body fixed to said quadrant in the region of a curved side thereof, a pin integral with said quadrant, and by an oscillating beak-shaped part cooperative with said plate-shaped member and angularly displaceable around said pin integral with said quadrant, said beak-shaped part defining an articulation having a lever with one extremity of the lever pivoted on said quadrant, coaxially with the pin, the other extremity of said lever cooperating with said second rung-shaped member for operating said gripper unit during the return travel of said slide, a first return spring provided to return said lever into a non-operative position, a trip integral with said quadrant to effect opening of the gripper unit, a second return spring provided, to return said quadrant into its operative position, after each forward travel thereof, the force applied by said first spring being less than that of said second spring.

* * * * *